US005145513A

United States Patent [19]

Matteazzi et al.

[11] Patent Number: 5,145,513

[45] Date of Patent: Sep. 8, 1992

[54] PROCESS FOR THE PREPARING VIA THE IN SITU REDUCTION OF THEIR COMPONENTS AND GRINDING OXIDE/METAL COMPOSITE MATERIALS

[75] Inventors: Paolo Matteazzi, Trevise, Italy; Gérard Le Caer, Villers-lés-Nancy; Elizabeth Grosse-Bauer, Vandoeuvre, both of France

[73] Assignee: Centre National de le Recherche Scientifique, Paris, France

[21] Appl. No.: 685,089

[22] Filed: Apr. 12, 1991

[30] Foreign Application Priority Data

Apr. 13, 1990 [FR] France ..... 90 04820

[51] Int. Cl.[5] ..... B23K 9/00; B22F 1/00

[52] U.S. Cl. ..... 75/255; 75/249; 419/12; 419/32; 428/614; 428/629

[58] Field of Search ..... 675/255, 249; 419/12, 419/32; 428/614, 629; 148/11.5 Q

[56] References Cited

U.S. PATENT DOCUMENTS

| | | | |
|---|---|---|---|
| 3,205,099 | 9/1965 | Vordahl | 148/4 |
| 3,723,092 | 3/1973 | Benjamin | 75/0.5 |
| 4,300,947 | 11/1981 | Habesch, Jr. et al. | 75/352 |
| 4,649,083 | 3/1987 | Fister et al. | 428/629 |
| 4,689,077 | 8/1987 | Chevigne et al. | 419/12 |
| 4,689,461 | 8/1987 | Gamberg | 428/629 |
| 4,749,545 | 6/1988 | Begg et al. | 419/32 |
| 4,909,840 | 3/1990 | Schlump | 75/255 |

FOREIGN PATENT DOCUMENTS 0277450 12/1987 European Pat. Off. .

OTHER PUBLICATIONS

Fecht et al. Met. Trans. 21A (1990) 2333.

*Primary Examiner*—Upendra Roy
*Attorney, Agent, or Firm*—Foley & Lardner

[57] ABSTRACT

A process for the preparation of composite materials consisting essentially of an oxide phase and a metal phase is effected by grinding a mixture of at least one oxide precursor of the metal phase of the composite with at least one reducing agent, the reducing agent being a precursor of the oxide phase. The grinding being performed in a high energy mechanical grinder for a sufficient length of time so that at least 80 percent of the oxide precursor is reduced to metal or to a metal alloy. The process is particularly valuable for the preparation of oxide/metal composite materials which have improved mechanical, electrical or radiation absorption properties.

10 Claims, No Drawings

PROCESS FOR THE PREPARING VIA THE IN SITU REDUCTION OF THEIR COMPONENTS AND GRINDING OXIDE/METAL COMPOSITE MATERIALS

BACKGROUND OF THE INVENTION

The present invention relates to the preparation of oxide/metal composite materials comprising an oxide phase and a metal phase.

The oxide/metal composite materials, which comprise 10 to 80% of metal phase and 90 to 20% of ceramic phase consisting essentially of oxides, have at one and the same time the properties of each the constituent phases, that is to say a good chemical stability, a high hardness, a high melting point, a good ductility and a good break strength.

The heretofore known methods of production of these materials, however, presents difficulties associated with the problem of wetting between the metal phase and the ceramic phase. This problem arises during the high temperature sintering operation which follows the step of grinding and mixing the initial ceramic and metal powders.

Attempts have been made to overcome these difficulties by using surface-active metals, preferably in the form of a pulverulent compound which can be decomposed by the action of heat (European Patent No. 0,277,450).

The present inventors have now developed a process for the preparation of oxide/metal composite materials by in situ formation of the oxide.

This process leads to a better bond between the oxide phase and the metal phase, which in some cases is reflected in a reciprocal solubility of the metal and oxide constituent elements, while ensuring a homogeneous distribution of the various phases in the powders obtained.

SUMMARY OF THE INVENTION

The present invention relates to a process for the preparation of oxide/metal composite materials and to the materials obtained thereby.

According to the invention, the process for the preparation of composite materials consisting essentially of an oxide phase and a metal phase comprises mixing at least one oxide precursor of the metal phase and at least one reducing agent, which is a precursor of the oxide phase, and subjecting the mixture to high-energy mechanical grinding without external supply of heat.

The amount of reducing agent used is 90 to 110% of the stoichiometric amount corresponding to the reduction reaction of the oxide precursor by the reducing agent, and the grinding time is chosen so as to reduce at least 80% of the metal atoms of the oxide precursor to the metal state, in the pure form or in the form of an alloy.

The analysis of X-ray diffraction diagrams recorded for samples taken at different times during grinding enables the end of the reaction to be determined.

The reduction of the oxide precursor is obtained by grinding, without an external supply of heat being necessary. It is, however, possible to heat the mixture introduced into the grinder without adversely affecting the result, on condition that the temperature remains below about 200° C.

In some cases it is advantageous to cool the reactor, grinding causing a rise in temperature. Cooling then allows the grinding to be carried out continuously and, consequently, the desired degree of reduction to be obtained more rapidly.

Although a total reduction is able to be obtained by the process of the invention, it may be desirable to restrict it to a partial reduction, in some cases, with a view to rendering a subsequent sintering more effective.

The process of the invention is particularly valuable for the preparation of oxide/metal composite materials which have improved mechanical or electrical properties or radiation absorption properties.

To this end, a metallic element capable of forming an oxide which is of value because of its hardness and its chemical and thermal stability will advantageously be used as a reducing agent.

The following may be mentioned as reducing metallic element: aluminum, titanium, yttrium, zirconium, magnesium or thorium, alone or in the form of an alloy or of a mixture of powders containing at least 90% by weight of reducing element. Aluminum is a particularly preferred reducing agent. It may advantageously be used in the form of recycled aluminum or in the form of an alloy containing at least 90% by weight of aluminum.

The oxide precursors of the metal phase which may be used in the process of the present invention are oxides which have a thermodynamic stability at ambient temperature of less than or equal to that of the oxide obtained from the reducing agent. Amongst these oxides, the oxides of the following elements may be mentioned: V, Cr, Mn, Fe, Co, Ni, Cu, Zn, Nb, Mo, Ag and W.

These oxides may be used in the pure form or in the form of a mineral containing them.

The high-energy mechanical grinding may be carried out using various high-energy grinders. Amongst the latter, the following may be mentioned by way of example: impact grinders, such as ball mills, ball annular mills, vibratory ball mills, planetary mills, roller mills, autogenous grinders, abrasion grinders and gas jet or liquid jet disintegrators. For a more complete description of these grinders, reference may be made to "Kirk-Othmer, Encyclopedia of Chemical Technology, 3rd edition, vol. 21, p 132 to 161".

Examples of such grinders which may be mentioned are the SPEX 8000® ball vibratory mill marketed by SPEX Industries Inc., USA, or the Pulvérisette 7® ball planetary mill marketed by FRITSCH.

DETAILED DESCRIPTION OF THE PREFERRED EMBODIMENTS

The present invention is described in more detail by the following examples which are given by way of non-limiting illustration.

For Examples 1 to 9 a "Pulvérisette 7" ball planetary mill marketed by Fritsch was used to carry out the high-energy mechanical grinding.

This mill is fitted with two cylindrical jars, each with a capacity of 45 ml, corresponding to a useful volume of 20 ml, and balls 15 mm in diameter which are made either of stainless steel (18% Cr, 8% Ni) or of tungsten carbide (93% WC+6% Co). Each cylindrical jar contains 7 balls. The mixture of powders is introduced into the mill in a glove box under an argon atmosphere, a Teflon seal ensuring leak-tightness. The effective centrifugal force resulting from the planetary movement corresponds to an acceleration of the order of 15 to 20 X G. The mill is at ambient temperature.

In said Examples 1 to 9, the total mass of powder used was 3 g when the jars of the mill were made of steel and 4 g when the jars were made of tungsten carbide; and grinding was carried out under an argon atmosphere.

EXAMPLE 1

Preparation of a $Mn/Al_2O_3$ Material

The jars and the balls of the mill were made of stainless steel.

2.121 g of $MnO_2$ and 0.879 g of Al were used, the amount of Al being calculated so as to reduce all of the oxide $MnO_2$, in accordance with the reaction equation:

$$3MnO_2+4Al \rightarrow 3Mn+2Al_2O_3$$

The total grinding time was 3 hours.

The mass ratio of the powder to the balls was 1/31.

The loss in mass of the balls during grinding was 0.16%

The (CoKα) x-ray diffraction diagram of the product obtained contains:

The characteristic lines of cubic α-manganese: line (330) d=0.210 nm, line (332) d=0.1908 nm and line (510) d=0.1749 nm.

The characteristic lines of rhombohedral α-alumina; line (012) d=0.3484 nm, line (104) d=0.2549 nm, line (113) d=0.210 nm (superimposed on an α-Mn line), line (024) d=0.1749 nm (superimposed on an α-Mn line), line (116) d=0.1602 nm, line (214) d=0.1406 nm and line (300) d=0.1377 nm.

The $MnO_2$ and Al lines have disappeared.

Traces of pollution by the steel from the jars and balls are visible.

EXAMPLE 2

Preparation of a $V/Al_2O_3$ Material

The jars and the balls of the mill were made of stainless steel.

2.007 g of $V_2O_5$ and 0.993 g of Al were used, the amount of Al being calculated so as to reduce all of the oxide $V_2O_5$, in accordance with the reaction equation $$3V_2O_5+10Al \rightarrow 6V+5Al_2O_3$$

The total grinding time was 3 hours.

The mass ratio of the powder to the balls was 1/31.

The loss in mass of the balls during grinding was 0.26%.

The (CoKα) X-ray diffraction diagram of the product obtained contains the characteristic lines of rhombohedral α-alumina mentioned in Example 1 and the characteristic lines of cubic vanadium, amongst which the most intense are: line (110) d=0.2158 nm, line (200) d=0.1514 nm and line (211) d=0.1239 nm. Traces of pollution by the steel from the jars and the balls are visible. The $V_2O_5$ and Al lines have disappeared.

EXAMPLE 3

Preparation of a $Cu/Al_2O_3$ Material

The jars and the balls of the mill were made of tungsten carbide.

3.262 g of CuO and 0.738 g of Al were used, the amount of Al being calculated so as to reduce all of the oxide CuO, in accordance with the reaction equation $$3CuO+2Al \rightarrow 3\ Cu+Al_2O_3$$

The total grinding time was 90 min.

The mass ratio of the powder to the balls was 1/40.

The loss in mass of the balls during grinding was 0.20%.

The (CoKα) X-ray diffraction diagram of the product obtained contains:

The characteristic lines of cubic copper metal: line (111) d=0.2086 nm, line (200) d=0.1807 nm, line (220) d=0.1278 nm, line (311) d=0.1090 nm and line (222) d=0.1043 nm.

The characteristic lines of α-alumina.

The presence of tungsten carbide is also noted.

The CuO and Al lines have disappeared.

EXAMPLE 4

Preparation of al $Ni/Al_2O_3$ Material

The jars and the balls of the mill were made of tungsten carbide.

3.224 g of NiO and 0.776 g of Al were used, the amount of Al being calculated so as to reduce all of the oxide NiO, in accordance with the reaction equation $$3NiO+2Al \rightarrow 3Ni+Al_2O_3$$

The total grinding time was 90 min.

The mass ratio of the powder to the balls was 1/42.

The loss in mass of the balls during grinding was 0.03%.

The (CoKα) X-ray diffraction diagram of the product obtained contains:

The characteristic lines of Ni metal: line (111) d=0.2037 nm, line (200) d=0.1765 nm, line (220) d=0.1248 nm, line (311) d=0.1064 nm and line (222) d=0.1019 nm.

The characteristic lines of rhombohedral α-alumina.

The presence of tungsten carbide is also noted.

The NiO and Al lines have disappeared.

EXAMPLE 5

Preparation of a $Cr/Al_2O_3$ Material

The jars and the balls of the mill were made of tungsten carbide.

2.952 g of $Cr_2O_3$ and 1.048 g of Al were used, the amount of Al being calculated so as to reduce all of the oxide $Cr_2O_3$, in accordance with the reaction equation $$Cr_2O_3+2Al \rightarrow 2Cr+Al_2O_3$$

The total grinding time was 90 min.

The mass ratio of the powder to the balls was 1/42.

The loss in mass of the balls during grinding was 0.02%.

The (CoKα) X-ray diffraction diagram of the product obtained contains:

The characteristic lines of cubic α-chromium metal: line (110) d=0.2046 nm, line (200) d=0.1445 nm, line (211) d=0.1181 nm and line (220) d=0.1021 nm.

The characteristic lines of rhombohedral α-alumina. The $Cr_2O_3$ and Al lines have disappeared. The presence of traces of tungsten carbide is noted.

EXAMPLE 6

Preparation of a $Zn/Al_2O_3$ Material

The jars and the balls of the mill were made of tungsten carbide.

3.276 of ZnO+0.724 g of Al were used, the amount of Al being calculated so as to reduce all of the oxide ZnO, in accordance with the reaction equation $$3ZnO+2Al \rightarrow 3Zn+Al_2O_3$$

The total grinding time was 90 minutes.

The mass ratio of the power to the balls was 1/42.

The loss in mass of the balls during grinding was 0.02%.

The (CoKα) X-ray diffraction diagram of the product obtained contains:

The characteristic lines of hexagonal zinc metal: line (002) d=0.2457 nm, line (100) d=0.2308 nm, line (101) d=0.2089 nm, line (102) d=0.1684 nm, line (103)+line (110) d=0.1336 nm, line (004) d=0.1232 nm, line (112) d=0.1173 nm, line (200) d=0.1156 nm, line (201) d=0.1125 nm, line (104) d=0.1087 nm, line (202) d=0.1046 nm and line (203) d=0.0945 nm.

The characteristic lines of rhombohedral α-alumina. The ZnO and Al lines have disappeared. The presence of traces of tungsten carbide is noted.

EXAMPLE 7

Preparation of an $Nb/Al_2O_3$ Material

The jars and the balls of the mill were made of tungsten carbide.

2.989 g of $Nb_2O_5$ and 1.011 g of Al were used, the amount of Al being calculated so as to reduce all of the oxide $Nb_2O_5$ in accordance with the reaction equation:

$$3Nb_2O_5+10Al \rightarrow 6Nb+5Al_2O_3$$

The total grinding time was 90 minutes.

The mass ratio of the powder to the balls was 1/42.

The loss in mass of the balls during grinding was 0.02%.

The (CoKα) x-ray diffraction diagram of the product obtained contains:

The characteristic lines of cubic niobium: line (110) d=0.2335 nm, line (200) d=0.1648 nm, line (211) d=0.1347 nm, line (220) d=0.1163 nm, and line (310) d=0.1043 nm.

The characteristic lines of rhombohedral α-alumina.

The $Nb_2O_5$ and Al lines have disappeared. The presence of traces of tungsten carbide is noted.

EXAMPLE 8

Preparation of an $Fe+Cr/Al_2O_3$ Material

The jars and the balls of the mill were made of stainless steel.

1.141 g of $Fe_2O_3$, 1.087 g of $Cr_2O_3$ and 0.772 g of Al were used, the amount of Al being calculated so as to reduce all of the mixture of 50% of $Fe_2O_3$+50% of $Cr_2O_3$ (atom), in accordance with the reaction equation $$Fe_2O_3+Cr_2O_3+4Al \rightarrow 2Fe+2Cr+2Al_2O_3,$$

Fe and Cr forming an alloy.

The total grinding time was 3 hours.

The mass ratio of the powder to the balls was 1/31.

The loss in mass of the balls during grinding was 0.38%.

The (CoKα) X-ray diffraction diagram of the product obtained shows the presence of alumina and of a Fe-Cr solid solution, the characteristic lines of which are: line (110) d=0.2029 nm, line (200) d=0.1431 nm, line (211) d=0.1172 nm and line (220) d=0.1018 nm. The Fe-Cr solid solution is also readily visible by $^{57}Fe$ Mössbauer spectrometry.

EXAMPLE 9

Preparation of an $Fe+Cr+Ni/Al_2O_3$ Material

The jars and the balls of the mill were made of stainless steel.

1.688 g of $Fe_2O_3$+0.391 g of $Cr_2O_3$+0.171 g of NiO+0.750 g of Al were used, the amount of Al being calculated so as to completely reduce a mixture in accordance with the reaction equation $$0.37Fe_2O_3 + 0.09Cr_2O_3 + 0.08NiO + 0.9733Al \longrightarrow 0.4866Al_2O_3 + 0.74Fe + 0.18Cr + 0.08Ni$$

The total grinding time was 3 hours.

The mass ratio of the powder to the balls was 1/32.

The loss in mass of the balls during grinding was 0.37%.

The (CoKα) X-ray diffraction diagram of the product obtained shows the presence of alumina and of an Fe-Ni-Cr alloy, the characteristic lines of which are: line (110) d=0.2030 nm, line (200) d=0.1429 nm, line (211) d=0.1170 nm and line (220) d=0.1015 nm. The (centered cubic ) Fe-Ni-Cr alloy is also readily visible by $^{57}Fe$ Mössbauer spectrometry.

Examples 10 to 13 were carried out using a SPEX 8000 ball mill from SPEX Industries Inc., USA.

This mill comprises a cylindrical vessel and balls of hexagonal tungsten carbide. The "tungsten carbide" material contains the elements usually present in sintered tungsten carbide materials, that is to say W, C and, as minor elements, Ta, Ti, Nb and Co. The cylinder has a diameter of 2¼" ($=5.7\times10^{-2}$ m) and a height of 2½" ($=6.3\times10^{-2}$ m). Mixtures of reducing agent and oxide powders and two balls of tungsten carbide (7/16", which is $=1.1\times10^{-2}$ m), in diameter and having a total mass of $19\times10^{-3}$ kg) are placed in the cylinder. The charge is prepared in a glove box under an argon or nitrogen atmosphere. The ratio of the mass of powder to the mass of the balls is of the order of 1/10. The powders are commercially available powders having particle sizes of a few μm to a few tens of μm. The cylinder is closed in a glove box (a Teflon seal ensures leak-tightness) and then placed in the mill. Grinding is achieved by vigorous agitation of the vessel in three perpendicular directions at a frequency of about 20 Hz. The mill is at ambient temperature.

EXAMPLE 10

Preparation of a $W/TiO_2$ Material

The tungsten oxide and titanium powders were mixed in the proportions defined by the reaction equation $$2WO_3+3Ti \rightarrow 2W+3TiO_2.$$

The initial mass of powder was 2.79 g. The mass ratio of the powder to the balls was 1/9.

Grinding was carried out for 24 hours under a nitrogen atmosphere. The consumption of the balls was 0.3%.

The (CoKα) X-ray diffraction diagram of the product obtained contains:

The characteristic lines of cubic tungsten metal: line (110) d=0.2236 nm, line (200) d=0.1581 nm, line (211)

d=0.1292 nm, line (220) d=0.1118 nm and line (310) d=0.1000 nm.

The characteristic lines of rutile $TiO_2$, amongst which those which are not masked by the tungsten lines are the following: line (110) d=0.3304 nm, line (101) d=0.2487 nm, line (210) d=0.2078 nm, line (211) d=0.1701 nm, line (220) d=0.1654 nm, line (002) d=0.1476 nm, line (301) d=0.1376 nm and line (112) d=0.1341 nm.

The characteristic lines of $WO_3$ have disappeared. The presence of traces of tungsten carbide is noted.

EXAMPLE 11

Preparation of a $W/Al_2O_3$ Material

The jar and the balls of the were made of tungsten carbide.

The tungsten oxide and aluminum powders were mixed in the proportions defined by the reaction equation:

$$WO_3+2Al \rightarrow W+Al_2O_3$$

The initial mass of powder was 2.43 g. The mass ratio of the powder to the balls was 1/7. Grinding was carried out for 24 hours under a nitrogen atmosphere. The consumption of balls was 2.6%.

The (CoKα) X-ray diffraction diagram of the product obtained contains:

The characteristic lines of cubic tungsten metal: line (110) d=0.2234 nm, line (200) d=0.1578 nm, line (211) d=0.1290 nm, line (220) d=0.1116 nm and line (310) d=0.0999 nm.

The characteristic lines of α-alumina. The presence of tungsten carbide is also noted.

The characteristic lines of $WO_3$ and of aluminum have disappeared.

EXAMPLE 12

Preparation of an $Mo/Al_2O_3$ Material

This example was carried out using a SPEX 8000 ball mill.

The jar and the balls of the mill were made of tungsten carbide.

The molybdenum oxide and aluminum powders were mixed in the proportions defined by the reaction equation:

$$MoO_3+2Al \rightarrow Mo+Al_2O_3$$

The initial mass of powder was 1.74 g. The mass ratio of the powder to the balls was 2/20. Grinding was carried out for 24 h under a nitrogen atmosphere. The consumption of the balls was 2.3%.

The (CoKα) x-ray diffraction diagram of the product obtained contains:

The characteristic lines of cubic molybdenum metal: line (110) d=0.2226 nm, line (200) d=0.1573 nm, line (211) d=0.1292 nm, line (220) d=0.1113 nm and line (310) d=0.0996 nm.

The characteristic lines of α-alumina.

The presence of tungsten carbide is also noted.

The characteristic lines of $MoO_3$ and of aluminum have disappeared.

EXAMPLE 13

Preparation of an $Fe/Al_2O_3$ Material

The jar and the balls of the mill were made of tungsten carbide.

The iron oxide and aluminum powders were mixed in the proportions defined by the reaction equation:

$$Fe_2O_3+2Al \rightarrow 2Fe+Al_2O_3$$

The initial mass of powder was 1.88 g. The mass ratio of the powder to the balls was 1/11. Grinding was carried out for 20 h under a nitrogen atmosphere. The consumption of balls was 0.8%.

The (CoKα) x-ray diffraction diagram of the product obtained contains:

The characteristic lines of cubic iron metal: line (110) d=0.2030 nm, line (200) d=0.1433 nm, line (211) d=0.1172 nm and line (220) d=0.1015 nm.

The characteristic lines of α-alumina.

The presence of tungsten carbide is also noted. The characteristic lines of hematite $\alpha$-$Fe_2O_3$ and of aluminum have disappeared. ($^{57}Fe$) Mössbauer spectrometry clearly shows that no further hematite is present. It demonstrates the presence of a little aluminum in the centered cubic iron and of a little iron in the α-alumina.

The foregoing description and examples have been set forth merely to illustrate the invention and are not intended to be limiting. Since modifications of the described embodiments incorporating the spirit and substance of the invention may occur to a person skilled in the art, the scope of the invention should be construed to include all variations falling within the ambit of the appended claims and equivalents thereof.

We claim:

1. A process for the preparation of composite materials consisting essentially of an oxide phase and a metal phase, said process comprising the step of:

grinding a mixture of at least one oxide precursor of said metal phase of said composite with at least one reducing agent, said reducing agent being a precursor of said oxide phase of said composite, to yield a mixture wherein the amount of said reducing agent is in the stoichiometric range of 90 percent to 110 percent of the amount necessary to reduce said oxide precursor to said metal phase, in a high energy mechanical grinder for a sufficient length of time so that at least 80 percent of said oxide precursor is reduced to said metal phase or to a metal alloy phase, wherein no external heat is applied to said grinder during said grinding step.

2. The process of claim 1, wherein said oxide precursor of said metal phase is one chosen from the group consisting of the oxides of V, Cr, Mn, Fe, Co, Ni, Cu, Zn, Nb, Mo, Ag, W and mixtures thereof.

3. The process of claim 1, wherein no external heat is applied to said oxide precursor and said reducing agent before said grinding step.

4. The process of claim 1, wherein said grinding is performed in an inert gas atmosphere.

5. The process of claim 1, wherein said reducing agent is a metal selected from the group consisting of aluminum, titanium, yttrium, zirconium, magnesium, thorium and mixtures thereof.

6. The process of claim 1, wherein said oxide precursor and said reducing agent are heated to a temperature of less than 200° C. before being placed into said grinder.

7. The process of claim 1, wherein said reducing agent is aluminum.

8. The process of claim 1, wherein said oxide precursor is a mixture of oxides of Fe and Cr, and said reducing agent is Al.

9. The process of claim 1, wherein said oxide precursor is a mixture of oxides of Fe, Cr and Ni, and said reducing agent is Al.

10. The process of claim 1, wherein said metal is in the form of an alloy containing at least 90% by weight of said metal.

* * * * *